US006932247B2

(12) United States Patent
Clerget

(10) Patent No.: US 6,932,247 B2
(45) Date of Patent: Aug. 23, 2005

(54) GRIPPING DEVICE FOR FLEXIBLE BAG DISPENSER

(75) Inventor: Bernard Clerget, Haudivilliers (FR)

(73) Assignee: Rexam Dispensing Systems, Le Treport (FR)

( * ) Notice: Subject to any disclaimer, the term of this patent is extended or adjusted under 35 U.S.C. 154(b) by 157 days.

(21) Appl. No.: 10/380,156

(22) PCT Filed: Sep. 20, 2001

(86) PCT No.: PCT/FR01/02921

§ 371 (c)(1),
(2), (4) Date: Mar. 17, 2003

(87) PCT Pub. No.: WO02/24342

PCT Pub. Date: Mar. 28, 2002

(65) Prior Publication Data

US 2004/0026459 A1 Feb. 12, 2004

(30) Foreign Application Priority Data

Sep. 21, 2000 (FR) ..... 00 12021

(51) Int. Cl.[7] ..... B65D 88/54

(52) U.S. Cl. ..... 222/321.9; 222/92; 222/105; 222/107

(58) Field of Search ..... 222/321.7, 105, 222/321.9, 92, 95, 107, 385, 474, 323–324, 465.1

(56) References Cited

U.S. PATENT DOCUMENTS

| | | | | | |
|---|---|---|---|---|---|
| 1,632,218 | A | * | 6/1927 | Chaffin et al. | 222/385 |
| 1,866,784 | A | * | 7/1932 | Williams | 222/321.9 |
| 2,038,778 | A | * | 4/1936 | Williams et al. | 239/333 |
| 2,099,595 | A | * | 11/1937 | Brown | 222/105 |
| 2,185,534 | A | * | 1/1940 | Bernhardt | 222/321.9 |
| 2,837,247 | A | * | 6/1958 | Stewart et al. | 222/321.9 |
| 3,288,334 | A | * | 11/1966 | Corsette | 222/107 |
| 3,411,503 | A | * | 11/1968 | Santomieri | 604/87 |
| 4,124,148 | A | * | 11/1978 | Vieler et al. | 222/321.8 |
| 4,174,055 | A | * | 11/1979 | Capra et al. | 222/319 |
| 4,690,311 | A | * | 9/1987 | Schultz | 222/324 |
| 4,821,372 | A | * | 4/1989 | Casiello | 16/425 |
| 4,856,677 | A | * | 8/1989 | Brunet et al. | 222/94 |
| 5,092,496 | A | * | 3/1992 | Gayle et al. | 222/386 |
| 5,222,632 | A | * | 6/1993 | Tada | 222/153.06 |
| 5,341,993 | A | * | 8/1994 | Haber et al. | 239/331 |
| 5,377,875 | A | * | 1/1995 | Kock et al. | 222/95 |
| 5,419,463 | A | * | 5/1995 | Mizushima et al. | 222/321.3 |
| 5,450,983 | A | * | 9/1995 | Stern et al. | 222/1 |
| 5,894,963 | A | * | 4/1999 | Hirota | 222/321.2 |
| 6,386,397 | B2 | * | 5/2002 | Brotspies et al. | 222/321.6 |
| 6,712,241 | B1 | * | 3/2004 | Garcia et al. | 222/107 |
| 2001/0054621 | A1 | * | 12/2001 | Weber | 222/108 |
| 2003/0094464 | A1 | * | 5/2003 | Decottignies | 222/105 |

FOREIGN PATENT DOCUMENTS

| | | |
|---|---|---|
| EP | 0763469 | 3/1997 |
| EP | 1057739 | 12/2000 |
| GB | 2262081 | 6/1993 |
| WO | WO 97/13706 | 4/1997 |
| WO | WO 98/43882 | 10/1998 |
| WO | WO 00/10910 | 3/2000 |

* cited by examiner

*Primary Examiner*—Frederick Nicolas
(74) *Attorney, Agent, or Firm*—Bacon & Thomas, PLLC

(57) ABSTRACT

A handle device for manually grasping an airless dispenser of the type including a drawing-off member provided with a dispensing head and fitted to a flexible pouch by means of a cylindrical fitting, wherein, at the top of the fitting, under the head, the fitting is provided with a set of fins whose bottom faces serve to receive and to be pressed by the fingers of the user.

7 Claims, 4 Drawing Sheets

GRIPPING DEVICE FOR FLEXIBLE BAG DISPENSER

The present invention relates to a handle device for taking hold of a liquid dispenser having a flexible pouch.

A dispenser of that type generally comprises a drawing-off member, such as an airless pump, provided with a dispensing head and fitted to the pouch by means of a cylindrical fitting.

Unfortunately, with such a dispenser, taking hold of the pouch generates deformation which is accompanied by an increase in the internal pressure. Such compression forces open the inlet valve of the pump, which interferes with dispensing by causing the quantity of liquid that is metered out to be larger than the desired quantity.

An object of the present invention is to solve that technical problem by preventing the user from pressing by hand on the pocket.

The invention achieves this object by means of a handle device for taking hold of an airless dispenser of the type comprising a drawing-off member provided with a dispensing head and fitted to a flexible pouch by means of a cylindrical fitting, said device being characterized in that, at the top of said fitting, under the head, said fitting is provided with a set of fins whose bottom faces serve to receive and to be pressed by the fingers of the user.

In a particular embodiment, the set of fins comprises two identical and diametrically-opposite side fins.

According to another characteristic, the bottom faces of the fins are of ergonomic profile matching the shape of the fingers.

According to another characteristic, at least at their peripheries, the fins are made of an elastically deformable plastics material.

According to yet another characteristic, the cross-section of each of the fins defines a projecting edge making it possible to suspend the pouch and/or to fix an external housing.

In a variant embodiment, the largest width of each of said fins is greater than the outside diameter of the fitting so as to form a link ledge.

Preferably, the bottom face of each of said fins is connected to the side wall of the fitting via a shoulder.

In another variant embodiment, around their inner edges, said fins define a central cavity which receives a locking collar for locking the drawing-off member.

The device of the present invention firstly makes it comfortable to take hold of the dispenser in the hand without exerting any stress on the pouch that might be detrimental to pump operation, and secondly makes it easier to press with the forefinger on the dispensing head.

The device of the invention is particularly ergonomic and matches various sizes and shapes of finger, which makes it very flexible to use.

The invention will be better understood on reading the following description with reference to the accompanying drawings, in which.

Figure 1:
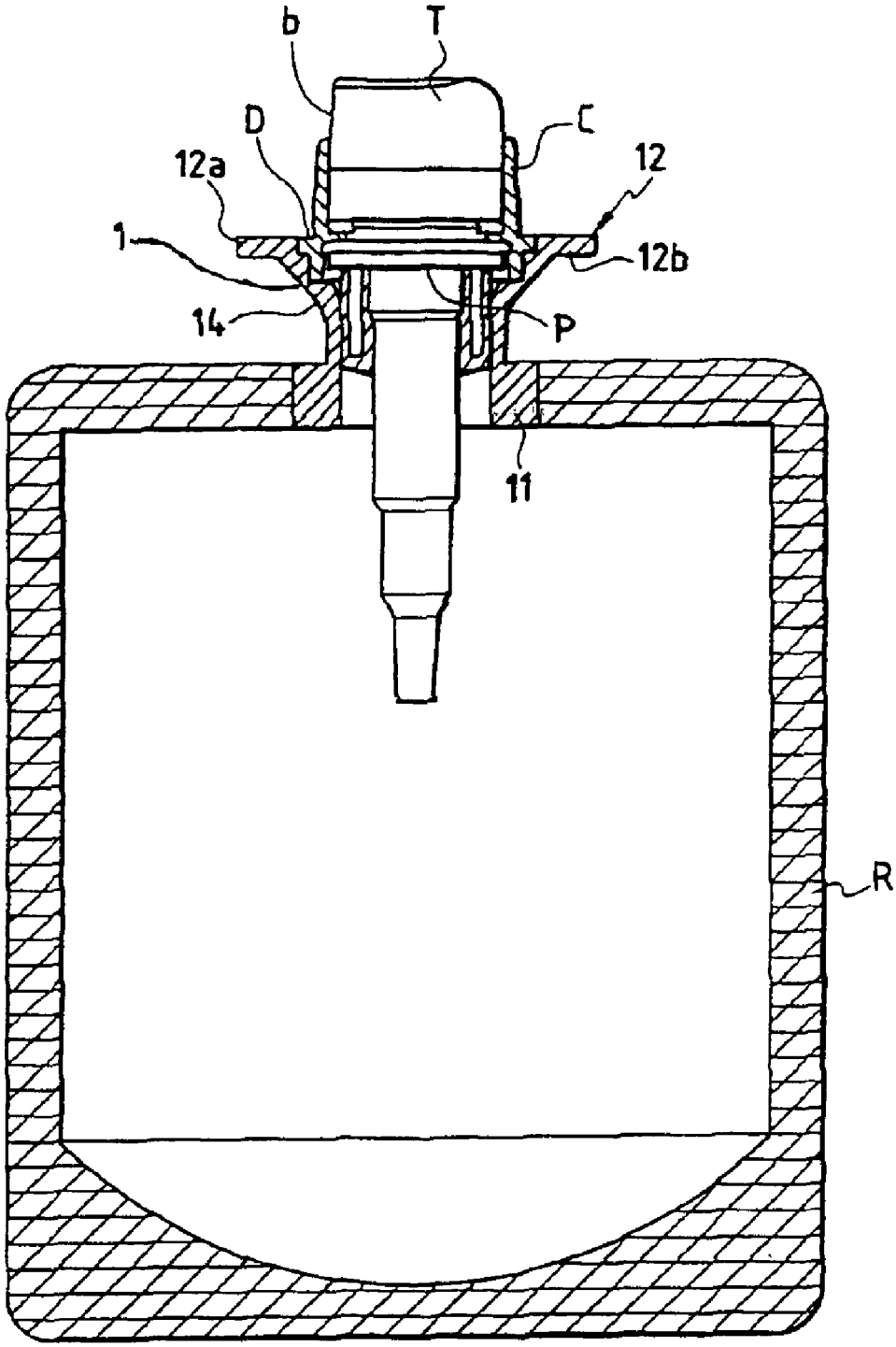
FIG. 1 is a view partially in section of a dispenser equipped with an embodiment of the device of the invention.

The dispenser shown in FIG. 1 comprises a drawing-off member P such as an airless pump provided with a spray head T forming a push button and provided with a nozzle b.

The pump P is fitted to a flexible pouch R forming a liquid reservoir, by means of a leaktight cylindrical fitting 1.

In this example, the dispenser is further provided with a collar C for locking the pump body into the fitting 1. The pump P remains free to turn inside the fitting 1.

At its bottom end, the fitting 1 is provided with a bush 11 provided with peripheral ribs 10 for sealing to the pocket R.

At its top end, under the head T, the fitting 1 is provided with a set of fins 12 whose bottom faces are suitable for and designed for receiving and being pressed by the fingers of the user, in particular while the head T is being actuated by hand.

Figure 4A:
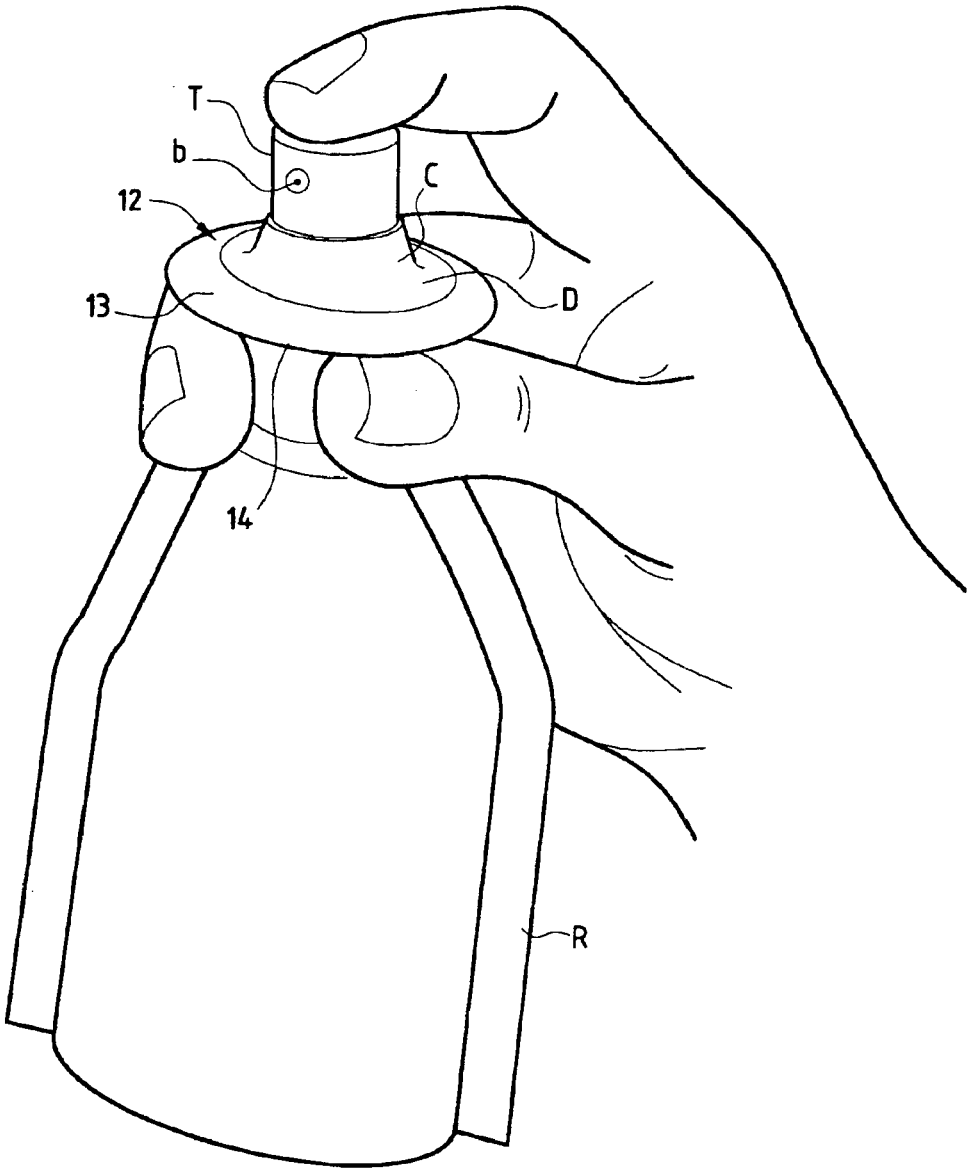
FIGS. 4A and 4B show how to take hold of the dispenser of FIGS. 1 and 2, as equipped with the device of the invention, respectively during the rest stage, and during the spraying stage.
Figure 4B:
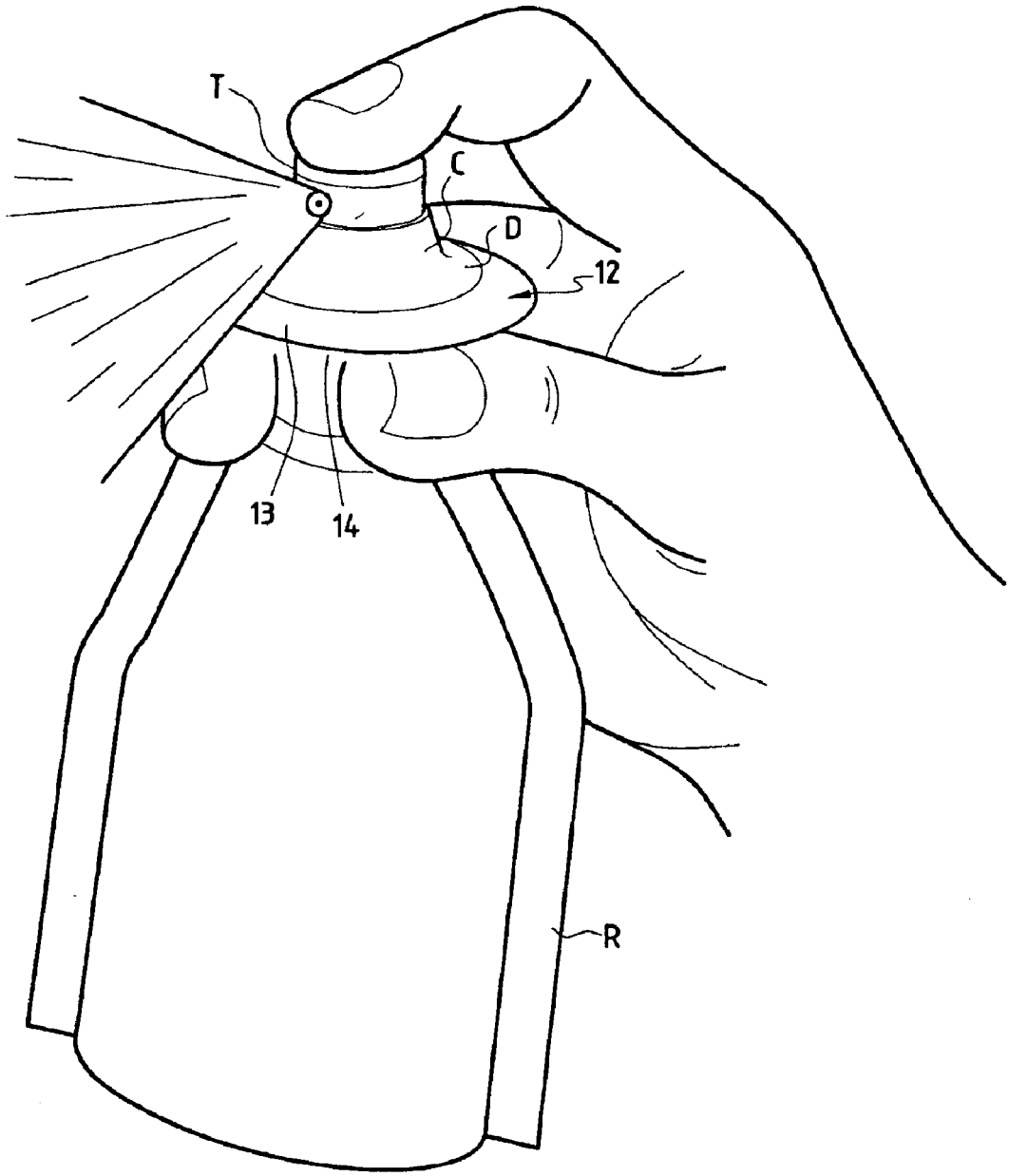

In the embodiment shown in the figures, the set of fins comprises two identical side fins 12*a*, 12*b* that are diametrically opposite each other about the axis of the dispenser (see FIGS. 4A and 4B).

To this end, the bottom face of each of the fins 12 has an ergonomic profile matching the shape of the fingers. In particular, the bottom face of each of the fins 12 is connected to the side wall of the fitting 1 via a shoulder 14 whose profile matches the configuration of the thumb and of the middle finger.

Thus, when taking hold of the dispenser, the fingers of the user come into position and fit naturally between the bush 11 and the fins 12, as shown in FIG. 4A, without being contact with a deformable zone of the flexible pouch R.

Preferably, and at least around their peripheries, the fins 12 are made of an elastically deformable plastics material so as to match various sizes and shapes of finger.

The largest width of each of the fins is, in this example, greater than the outside diameter of the fitting. The fins 12*a*, 12*b* thus meet around the central portion of the fitting 1 by forming a link ledge 13. The inner edges of the fins 12 thus define a central cavity which receives the locking collar C.

The collar C is extended transversely by a flange D extending flush with the inner edges of the fins 12*a*, 12*b*.

In the variant shown in FIGS. 4A and 4B, the collar C is frustoconical, and the flange D is flared so as to remove any discontinuity in profile between the collar C and the fins 12.

Since the collar C is made of a rigid material, it is then possible, and in particular in the variant shown in FIGS. 4A and 4B, to make the fins entirely of an elastomer material.

Figure 2:
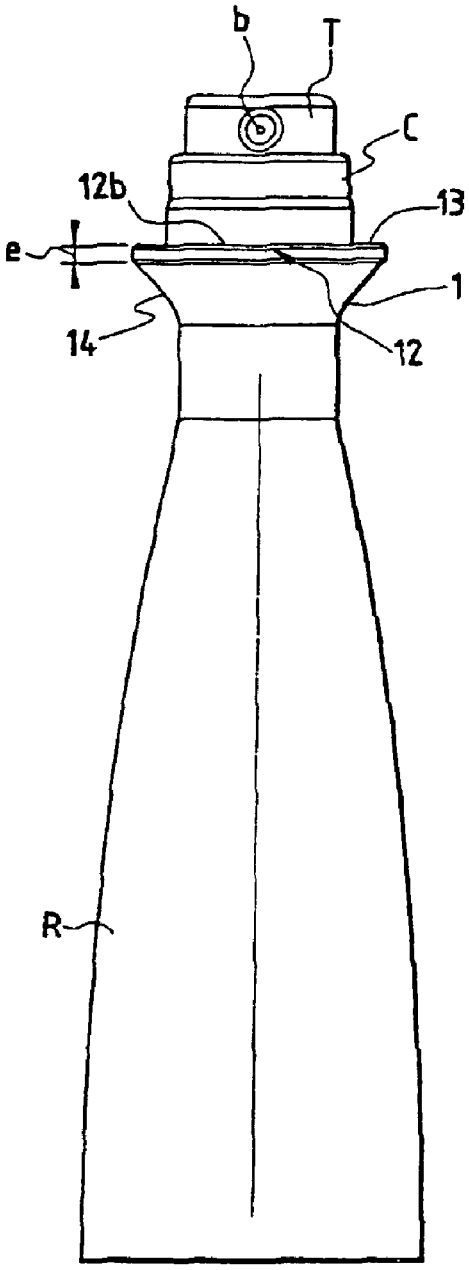
FIG. 2 is an external profile view of the dispenser of FIG. 1.
Figure 3:
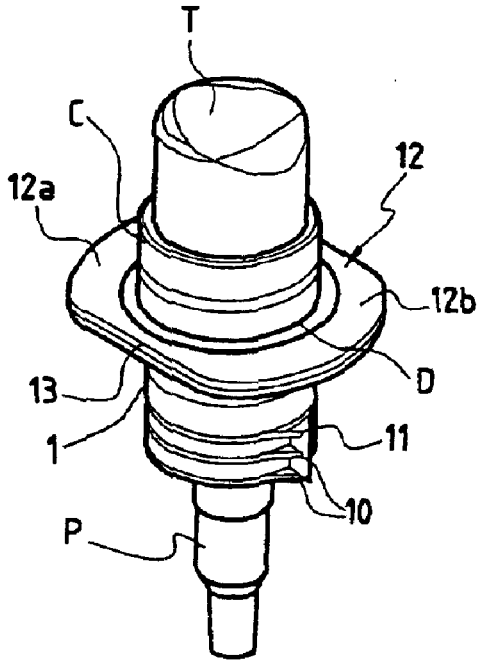
FIG. 3 is a perspective view of the device of the invention, associated with a drawing-off member.

The cross-section of each of the fins 12 and of the ledge 13 define a projecting edge of thickness e (see FIG. 2) making it possible to suspend the pouch R while it is being filled during the packaging stage in which the liquid is packaged and/or to fix an external housing (not shown) in which the pouch R is enclosed.

What is claimed is:

1. A handle device for manually grasping an airless dispenser including a drawing-off member provided with a dispensing head said device comprising a cylindrical fitting including, at the top of the fitting, a set of laterally extending fins having bottom faces that serve to receive and to be pressed by fingers of a user, said fins having inner edges defining a central cavity for receiving a locking collar adapted to secure the drawing-off member to the fitting, said fins meeting around the central portion of the fitting by forming a ledge, the ledge and the cross-sections of the fins defining a projecting edge of thickness enabling a pouch associated with the fitting to be suspended during filling and enabling an external housing for enclosing said pouch to be fixed, said fitting configured to support at least partially above the fins said drawing-off member to be associated with said pouch.

2. The device according to claim 1, wherein the set of fins comprises two identical and diametrically-opposite side fins.

3. The device according to claim 1, wherein the bottom faces of the fins are of ergonomic profile matching the shape of the fingers of a user.

4. The device according to claim 1, wherein, at least at their peripheries, the fins are made of an elastically deformable plastic material.

5. The device according to claim 1, wherein the largest width of each of said fins is greater than an outside diameter of the fitting so as to form a link ledge.

6. The device according to claim 1, wherein the bottom face of each of said fins is connected to the side wall of the fitting via a shoulder.

7. The device according to claim 1, wherein said collar is extended transversely by a flange that flares so as to be flush with the inner edges of the fins.

* * * * *